US008313306B2

(12) United States Patent
Stiles, Jr. et al.

(10) Patent No.: US 8,313,306 B2
(45) Date of Patent: Nov. 20, 2012

(54) METHOD OF OPERATING A SAFETY VACUUM RELEASE SYSTEM

(75) Inventors: Robert W. Stiles, Jr., Cary, NC (US); Lars Hoffmann Berthelsen, Kolding (DK)

(73) Assignees: Pentair Water Pool and Spa, Inc., Sanford, NC (US); Danfoss Low Power Drives, Graasten (DK)

( * ) Notice: Subject to any disclaimer, the term of this patent is extended or adjusted under 35 U.S.C. 154(b) by 420 days.

(21) Appl. No.: 12/572,774

(22) Filed: Oct. 2, 2009

(65) Prior Publication Data

US 2010/0092308 A1 Apr. 15, 2010

Related U.S. Application Data

(60) Provisional application No. 61/102,935, filed on Oct. 6, 2008.

(51) Int. Cl.
*F04B 49/06* (2006.01)

(52) U.S. Cl. ..... 417/26; 417/44.11; 417/53; 4/509

(58) Field of Classification Search ..... 417/26, 417/44.11, 45, 53; 4/509
See application file for complete search history.

(56) References Cited

U.S. PATENT DOCUMENTS

| | | | |
|---|---|---|---|
| 1,061,919 | A | 5/1913 | Miller |
| 2,238,597 | A | 4/1941 | Page |
| 2,767,277 | A | 12/1951 | Wirth |
| 3,191,935 | A | 6/1965 | Uecker |
| 3,558,910 | A | 1/1971 | Dale et al. |
| 3,581,895 | A | 6/1971 | Howard et al. |
| 3,838,597 | A | 10/1974 | Montgomery et al. |
| 3,953,777 | A | 4/1976 | McKee |
| 3,963,375 | A | 6/1976 | Curtis |
| 4,021,700 | A | 5/1977 | Ellis-Anwyl |
| 4,123,792 | A | 10/1978 | Gephart et al. |
| 4,168,413 | A | 9/1979 | Halpine |
| 4,319,712 | A | 3/1982 | Bar |
| 4,370,098 | A | 1/1983 | McClain et al. |
| 4,402,094 | A | 9/1983 | Sanders |
| 4,419,625 | A | 12/1983 | Bejot et al. |
| 4,420,787 | A | 12/1983 | Tibbits et al. |
| 4,449,260 | A | 5/1984 | Whitaker |
| 4,998,097 | A | 3/1991 | Noth et al. |
| 5,079,784 | A | 1/1992 | Rist et al. |
| 5,100,298 | A | 3/1992 | Shibata et al. |
| RE33,874 | E | 4/1992 | Miller |
| 5,172,089 | A | 12/1992 | Wright et al. |
| 5,473,497 | A | 12/1995 | Beatty |
| 5,545,012 | A | 8/1996 | Anastos et al. |
| 5,550,753 | A | 8/1996 | Tompkins et al. |

(Continued)

FOREIGN PATENT DOCUMENTS

| | | |
|---|---|---|
| DE | 19736079 | 2/1999 |

(Continued)

*Primary Examiner* — Charles Freay
(74) *Attorney, Agent, or Firm* — Quarles & Brady LLP

(57) ABSTRACT

Embodiments of the invention provide a method of operating a safety vacuum release system (SVRS) with a controller for a pump including a motor. The method can include measuring an actual power consumption of the motor necessary to pump water and overcome losses. The method can include triggering the SVRS when a dynamic suction blockage is identified in order to shut down the pump substantially immediately. The SVRS can also be triggered when a dead head condition is identified based on the actual power consumption.

12 Claims, 7 Drawing Sheets

U.S. PATENT DOCUMENTS 5,570,481 A 11/1996 Mathis et al.
5,577,890 A 11/1996 Nielsen et al.
5,633,540 A 5/1997 Moan
5,682,624 A 11/1997 Ciochetti
5,690,476 A 11/1997 Miller
5,820,350 A 10/1998 Mantey et al.
5,833,437 A 11/1998 Kurth et al.
5,894,609 A 4/1999 Barnett
5,907,281 A 5/1999 Miller, Jr. et al.
5,930,092 A 7/1999 Nystrom
5,947,700 A 9/1999 McKain et al.
5,959,534 A 9/1999 Campbell et al.
5,991,939 A 11/1999 Mulvey
6,043,461 A 3/2000 Holling et al.
6,045,333 A 4/2000 Breit
6,059,536 A 5/2000 Stingl
6,098,654 A 8/2000 Cohen et al.
6,157,304 A 12/2000 Bennett et al.
6,171,073 B1 1/2001 McKain et al.
6,199,224 B1 3/2001 Versland
6,238,188 B1 5/2001 Lifson
6,342,841 B1 1/2002 Stingl
6,354,805 B1 3/2002 Moller
6,364,621 B1 4/2002 Yamauchi
6,390,781 B1 5/2002 McDonough
6,468,042 B2 10/2002 Moller
6,468,052 B2 10/2002 McKain et al.
6,501,629 B1 12/2002 Marriott
6,504,338 B1 1/2003 Eichorn
6,522,034 B1 2/2003 Nakayama
6,534,940 B2 3/2003 Bell et al.
6,534,947 B2 3/2003 Johnson et al.
6,623,245 B2 9/2003 Meza et al.
6,636,135 B1 10/2003 Vetter
6,696,676 B1 2/2004 Graves et al.
6,709,240 B1 3/2004 Schmalz et al.
6,806,677 B2 10/2004 Kelly et al.
6,875,961 B1 4/2005 Collins
6,933,693 B2 8/2005 Schuchmann
6,941,785 B2 9/2005 Haynes et al.
6,965,815 B1 11/2005 Tompkins et al.
6,976,052 B2 12/2005 Tompkins et al.
7,117,120 B2 10/2006 Beck et al.
7,690,897 B2 * 4/2010 Branecky et al. ..... 417/44.11
7,874,808 B2 * 1/2011 Stiles ..... 417/18
2002/0190687 A1 12/2002 Bell et al.
2003/0106147 A1 6/2003 Cohen et al.
2004/0062658 A1 4/2004 Beck et al.
2004/0090197 A1 5/2004 Schuchmann
2006/0090255 A1 * 5/2006 Cohen ..... 4/509
2008/0095638 A1 4/2008 Branecky
2008/0095639 A1 4/2008 Bartos et al.
2008/0168599 A1 7/2008 Caudill et al.
2012/0020810 A1 * 1/2012 Stiles et al. ..... 417/44.11

FOREIGN PATENT DOCUMENTS

EP 0246769 11/1987
EP 0833436 4/1998

* cited by examiner

METHOD OF OPERATING A SAFETY VACUUM RELEASE SYSTEM

RELATED APPLICATIONS

This application claims priority under 35 U.S.C. §119 to U.S. Provisional Patent Application No. 61/102,935 filed on Oct. 6, 2008, the entire contents of which is incorporated herein by reference.

BACKGROUND

Pool pumps are used to move water in one or more aquatic applications, such as pools, spas, and water features. The aquatic applications include one or more water inlets and one or more water outlets. The water outlets are connected to an inlet of the pool pump. The pool pump generally propels the water though a filter and back into the aquatic applications though the water inlets. For large pools, the pool pump must provide high flow rates in order to effectively filter the entire volume of pool water. These high flow rates can result in high velocities in the piping system connecting the water outlets and the pool pump. If a portion of the piping system is obstructed or blocked, this can result in a high suction force near the water outlets of the aquatic applications. As a result, foreign objects can be trapped against the water outlets, which are often covered by grates in the bottom or sides of the pool. Systems have been developed to try to quickly shut down the pool pump when a foreign object is obstructing the water outlets of the aquatic applications. However, these systems often result in nuisance tripping (i.e., the pool pump is shut down too often when there are no actual obstructions).

SUMMARY

Some embodiments of the invention provide a method of operating a safety vacuum release system (SVRS) with a controller for a pump including a motor. The method can include measuring an actual power consumption of the motor necessary to pump water and overcome losses, calculating an absolute power variation based on the actual power consumption, and incrementing a dynamic counter value if the absolute power variation is negative. The method can also include calculating a relative power variation based on the actual power consumption and identifying a dynamic suction blockage if the dynamic counter exceeds a dynamic counter threshold value and/or the relative power variation is below a negative threshold. The method can further include triggering the SVRS when the dynamic suction blockage is identified in order to shut down the pump substantially immediately.

Some embodiments of the invention provide a method including filtering the actual power consumption with a fast low-pass filter to obtain a current power consumption and incrementing an absolute counter value if the actual power consumption and/or the current power consumption are greater than a threshold power curve. The method can also include identifying a dead head condition if the absolute counter value exceeds an absolute counter threshold value and triggering the suction vacuum release system when the dead head condition is identified in order to shut down the pump substantially immediately.

DETAILED DESCRIPTION

Figure 1:
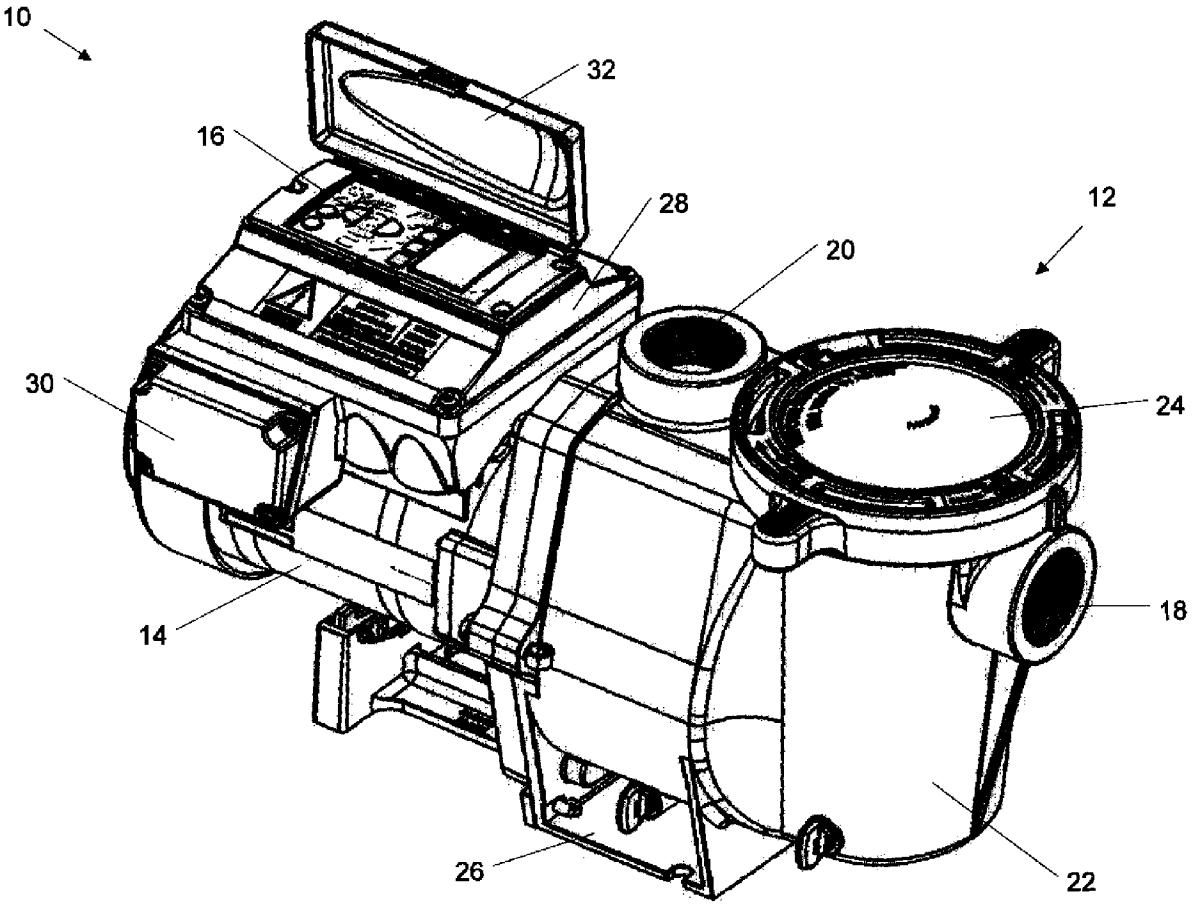
FIG. 1 is a perspective view of a pool pump according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIG. 1 illustrates a pool pump 10 according to one embodiment of the invention. The pool pump 10 can be used for any suitable aquatic application, such as pools, spas, and water features. The pool pump 10 can include a housing 12, a motor 14, and an on-board controller 16. In some embodiments, the motor 14 can be a variable speed motor. In one embodiment, the motor 14 can be driven at four or more different speeds. The housing 12 can include an inlet 18, an outlet 20, a basket 22, a lid 24, and a stand 26. The stand 26 can support the motor 14 and can be used to mount the pool pump 10 on a suitable surface (not shown).

In some embodiments, the on-board controller 16 can be enclosed in a case 28. The case 28 can include a field wiring compartment 30 and a cover 32. The cover 32 can be opened and closed to allow access to the on-board controller 16 and protect it from moisture, dust, and other environmental influences. The case 28 can be mounted on the motor 14. In some embodiments, the field wiring compartment 30 can include a power supply to provide power to the motor 14 and the on-board controller 16.

Figure 2:
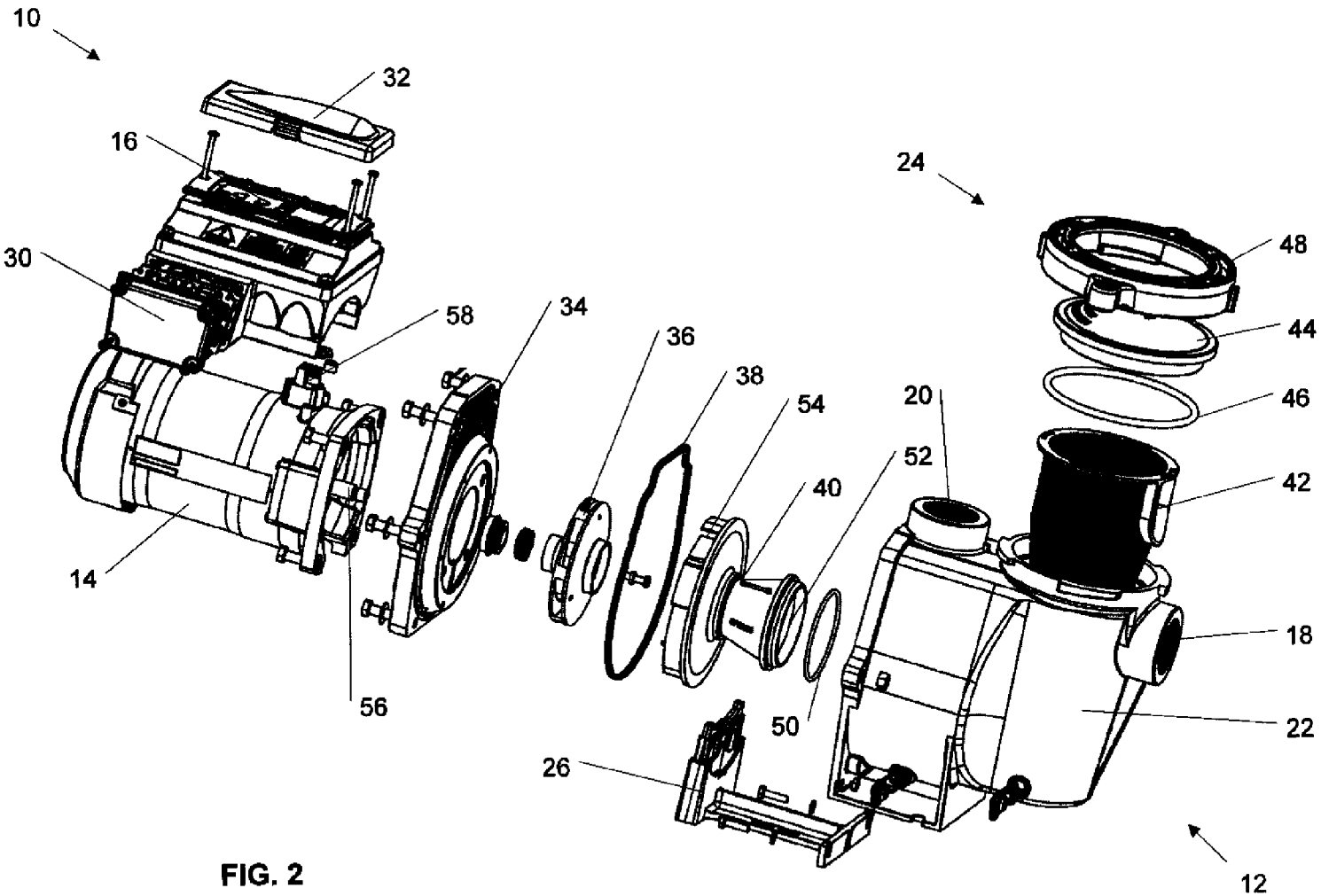
FIG. 2 is an exploded perspective view of the pool pump of FIG. 1.

FIG. 2 illustrates the internal components of the pool pump 10 according to one embodiment of the invention. The pool pump 10 can include seal plate 34, an impeller 36, a gasket 38, a diffuser 40, and a strainer 42. The strainer 42 can be inserted into the basket 22 and can be secured by the lid 24. In some embodiments, the lid 24 can include a cap 44, an O-ring 46, and a nut 48. The cap 44 and the O-ring 46 can be coupled to the basket 22 by screwing the nut 48 onto the basket 22. The O-ring 46 can seal the connection between the basket 22 and the lid 24. An inlet 52 of the diffuser 40 can be fluidly sealed to the basket 22 with a seal 50. In some embodiments, the diffuser 40 can enclose the impeller 36. An outlet 54 of the diffuser 40 can be fluidly sealed to the seal plate 34. The seal plate 34 can be sealed to the housing 12 with the gasket 38. The motor 14 can include a shaft 56, which can be coupled to the impeller 36. The motor 14 can rotate the impeller 36, drawing fluid from the inlet 18 through the strainer 42 and the diffuser 40 to the outlet 20.

In some embodiments, the motor 14 can include a coupling 58 to connect to the on-board controller 16. In some embodiments, the on-board controller 16 can automatically operate the pool pump 10 according to at least one schedule. If two or more schedules are programmed into the on-board controller 16, the schedule running the pool pump 10 at the highest speed can have priority over the remaining schedules. In some embodiments, the on-board controller 16 can allow a manual operation of the pool pump 10. If the pool pump 10 is manually operated and is overlapping a scheduled run, the scheduled run can have priority over the manual operation independent of the speed of the pool pump 10. In some embodiments, the on-board controller 16 can include a manual override. The manual override can interrupt the scheduled and/or manual operation of the pool pump 10 to allow for, e.g., cleaning and maintenance procedures. In some embodiments, the on-board controller 16 can monitor the operation of the pool pump 10 and can indicate abnormal conditions of the pool pump 10.

Figure 3B:
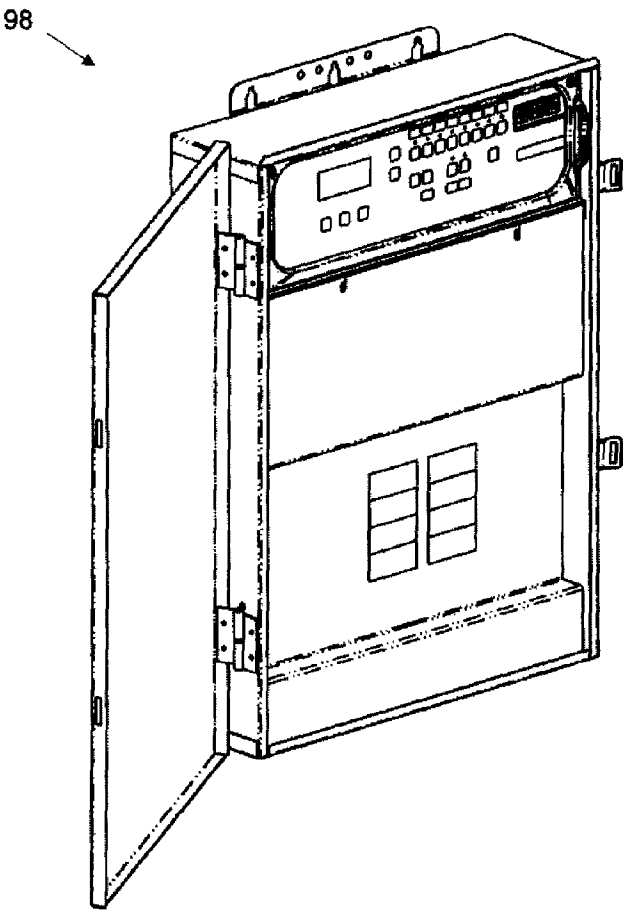
FIG. 3B is a perspective view of an external controller according to one embodiment of the invention.
Figure 3A:
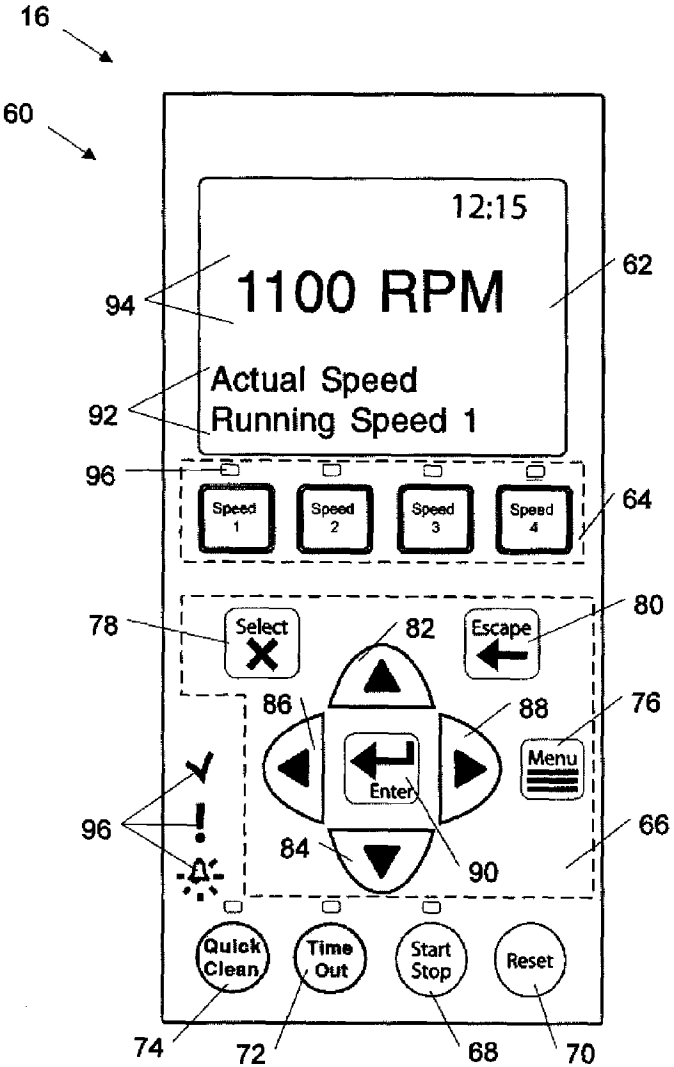
FIG. 3A is a front view of an on-board controller according to one embodiment of the invention.

FIG. 3A illustrates a user interface 60 for the on-board controller 16 according to one embodiment of the invention. The user interface 60 can include a display 62, at least one speed button 64, navigation buttons 66, a start-stop button 68, a reset button 70, a manual override button 72, and a "quick clean" button 74. The manual override button 72 can also be called "time out" button. In some embodiments, the navigation buttons 66 can include a menu button 76, a select button 78, an escape button 80, an up-arrow button 82, a down-arrow button 84, a left-arrow button 86, a right-arrow button 88, and an enter button 90. The navigation buttons 66 and the speed buttons 64 can be used to program a schedule into the on-board controller 16. In some embodiments, the display 62 can include a lower section 92 to display information about a parameter and an upper section 94 to display a value associated with that parameter. In some embodiments, the user interface 60 can include light emitting diodes (LEDs) 96 to indicate normal operation and/or a detected error of the pool pump 10.

The on-board controller 16 operates the motor 14 to provide a safety vacuum release system (SVRS) for the aquatic applications. If the on-board controller 16 detects an obstructed inlet 18, the on-board controller 16 can quickly shutdown the pool pump 10. In some embodiments, the on-board controller 16 can detect the obstructed inlet 18 based only on measurements and calculations related to the power consumption of the motor 14 (e.g., the power needed to rotate the motor shaft 56). In some embodiments, the on-board controller 16 can detect the obstructed inlet 18 without any additional inputs (e.g., without pressure, flow rate of the pumped fluid, speed or torque of the motor 14).

FIG. 3B illustrates an external controller 98 for the pool pump 10 according to one embodiment of the invention. The external controller 98 can communicate with the on-board controller 16. The external controller 98 can control the pool pump 10 in substantially the same way as the on-board controller 16. The external controller 98 can be used to operate the pool pump 10 and/or program the on-board controller 16, if the pool pump 10 is installed in a location where the user interface 60 is not conveniently accessible.

Figure 4:
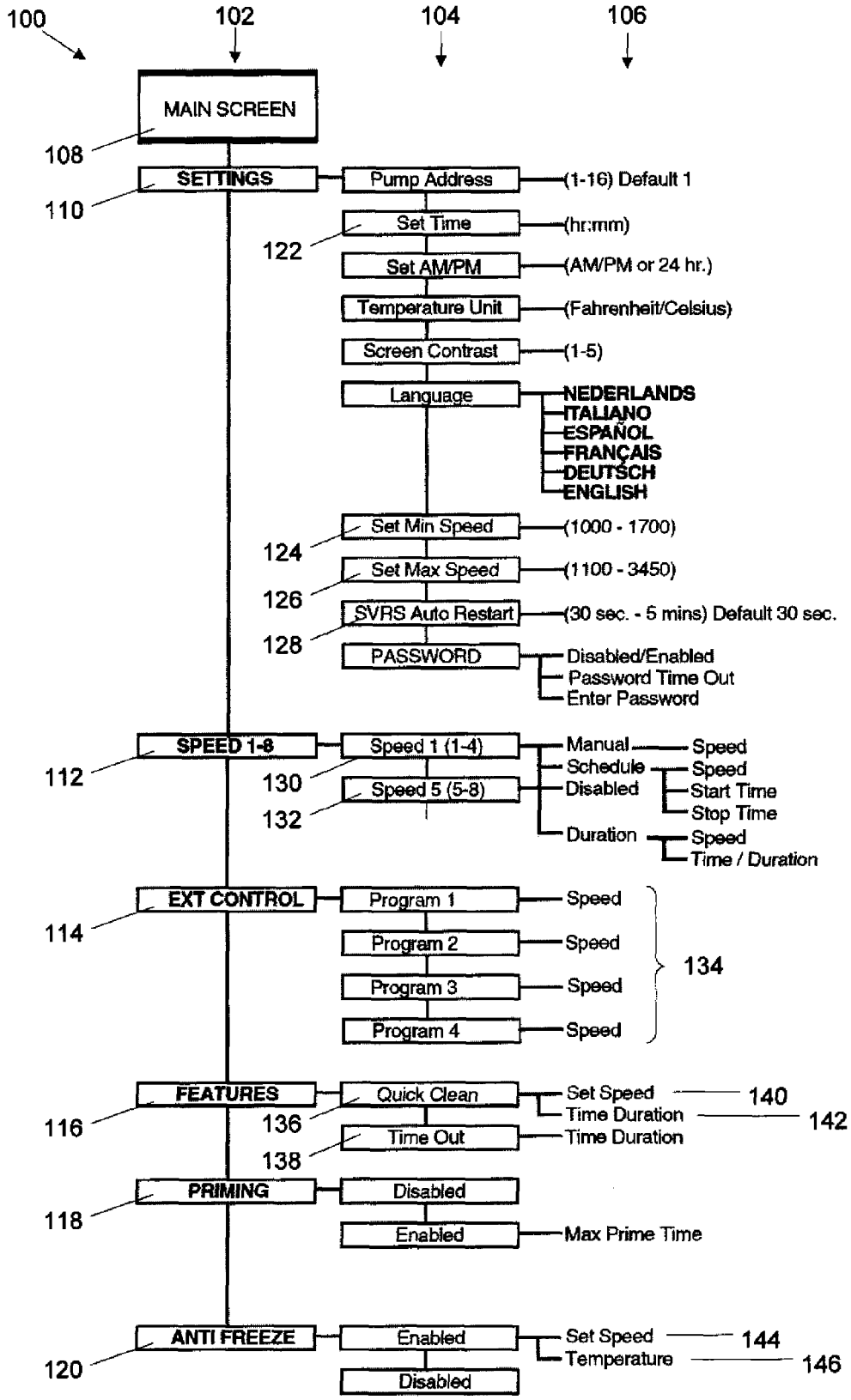
FIG. 4 is a flow chart of settings of the on-board controller of FIG. 3A and/or the external controller of FIG. 3B according to one embodiment of the invention.

FIG. 4 illustrates a menu 100 for the on-board controller 16 according to one embodiment of the invention. In some embodiments, the menu 100 can be used to program various features of the on-board controller 16. In some embodiments, the menu 100 can include a hierarchy of categories 102, parameters 104, and values 106. From a main screen 108, an operator can, in some embodiments, enter the menu 100 by pressing the menu button 76. The operator can scroll through the categories 102 using the up-arrow button 82 and the down-arrow button 84. In some embodiments, the categories 102 can include settings 110, speed 112, external control 114, features 116, priming 118, and anti freeze 120. In some embodiments, the operator can enter a category 102 by pressing the select button 78. The operator can scroll through the parameters 104 within a specific category 102 using the up-arrow button 82 and the down-arrow button 84. The operator can select a parameter 104 by pressing the select button 78 and can adjust the value 106 of the parameter 104 with the up-arrow button 82 and the down-arrow button 84. In some embodiments, the value 106 can be adjusted by a specific increment or the user can select from a list of options. The user can save the value 106 by pressing the enter button 90. By pressing the escape button 80, the user can exit the menu 100 without saving any changes.

In some embodiments, the settings category 110 can include a time setting 122, a minimum speed setting 124, a maximum speed setting 126, and a SVRS automatic restart setting 128. The time setting 122 can be used to run the pool pump 10 on a particular schedule. The minimum speed setting 124 and the maximum speed setting 126 can be adjusted according to the volume of the aquatic applications. An installer of the pool pump 10 can provide the minimum speed setting 124 and the maximum speed setting 126. The on-board controller 16 can automatically prevent the minimum speed setting 124 from being higher than the maximum speed setting 126. The pool pump 10 will not operate outside of these speeds in order to protect flow-dependent devices with minimum speeds and pressure-sensitive devices (e.g., filters) with maximum speeds. The SVRS automatic restart setting 128 can provide a time period before the on-board controller 16 will resume normal operation of the pool pump 10 after an obstructed inlet 18 has been detected and the pool pump 10 has been stopped. In some embodiments, there can be two minimum speed settings—one for dead head detection (higher speed) and one for dynamic detection (lower speed).

In some embodiments, the speed category 112 can be used to input data for running the pool pump 10 manually and/or automatically. In some embodiments, the on-board controller 16 can store a number of manual speeds 130 and a number of scheduled runs 132. In some embodiments, the manual speeds 130 can be programmed into the on-board controller 16 using the up-arrow button 82, the down-arrow button 84 and the enter button 90. Once programmed, the manual speeds 130 can be accessed by pressing one of the speed buttons 64 on the user interface 60. The scheduled runs 132 can be programmed into the on-board controller 16 using the up-arrow button 82, the down-arrow button 84, and the enter button 90. For the scheduled runs 132, a speed, a start time, and a stop time can be programmed. In some embodiments, the scheduled runs 132 can be programmed using a speed, a start time, and a duration. In some embodiments, the pool pump 10 can be programmed to run continuously.

The external control category 114 can include various programs 134. The programs 134 can be accessed by the external controller 98. The quantity of programs 134 can be equal to the number of scheduled runs 132.

The features category 116 can be used to program a manual override. In some embodiments, the parameters can include a "quick clean" program 136 and a "time out" program 138. The "quick clean" program 136 can include a speed setting 140 and a duration setting 142. The "quick clean" program 136 can be selected by pressing the "quick clean" button 74 located on the user interface 60. When pressed, the "quick clean" program 136 can have priority over the scheduled and/or manual operation of the pool pump 10. After the pool pump 10 has been operated for the time period of the duration setting 142, the pool pump 10 can resume to the scheduled and/or manual operation. If the SVRS has been previously triggered and the time period for the SVRS automatic restart 128 has not yet elapsed, the "quick clean" program 136 may not be initiated by the on-board controller 16. The "time out" program 138 can interrupt the operation of the pool pump 10 for a certain amount of time, which can be programmed into the on-board controller 16. The "time out" program 138 can be selected by pressing the "time out" button 72 on the user interface 60. The "time out" program 138 can be used to clean the aquatic application and/or to perform maintenance procedures.

In the priming category 118, the priming of the pool pump 10 can be enabled or disabled. If the priming is enabled, a duration for the priming sequence can be programmed into the on-board controller 16. In some embodiments, the priming sequence can be run at the maximum speed 126. The priming sequence can remove substantially all air in order to allow water to flow through the pool pump 10 and/or connected piping systems.

In some embodiments, a temperature sensor (not shown) can be connected to the on-board controller 16 in order to provide an anti-freeze operation for the pumping system and the pool pump 10. In the anti-freeze category 120, a speed setting 144 and a temperature setting 146 at which the pool pump 10 can be activated to prevent water from freezing in the pumping system can be programmed into the on-board controller 16. If the temperature sensor detects a temperature lower than the temperature setting 146, the pool pump 10 can be operated according to the speed setting 144. However, the anti-freeze operation can also be disabled.

Figure 5A:
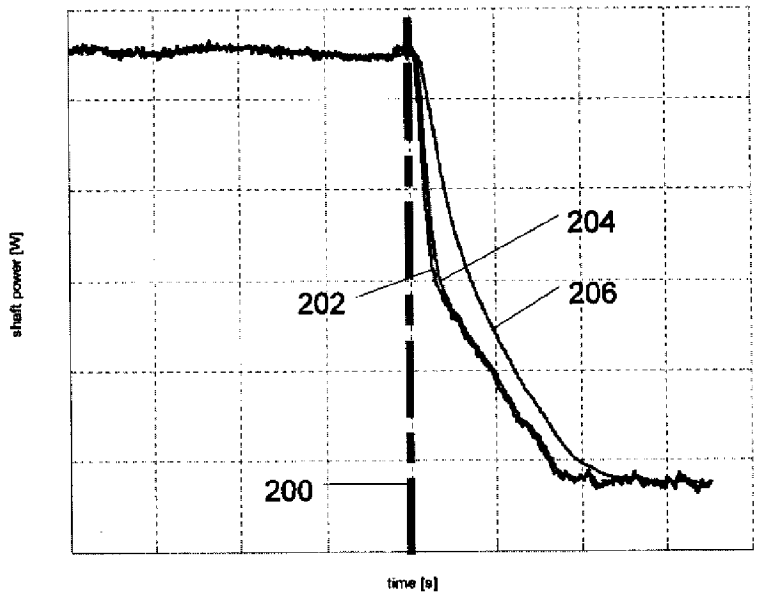
FIG. 5A is a graph of an absolute power variation of the pool pump when a clogged suction pipe occurs at a certain time.
Figure 5B:
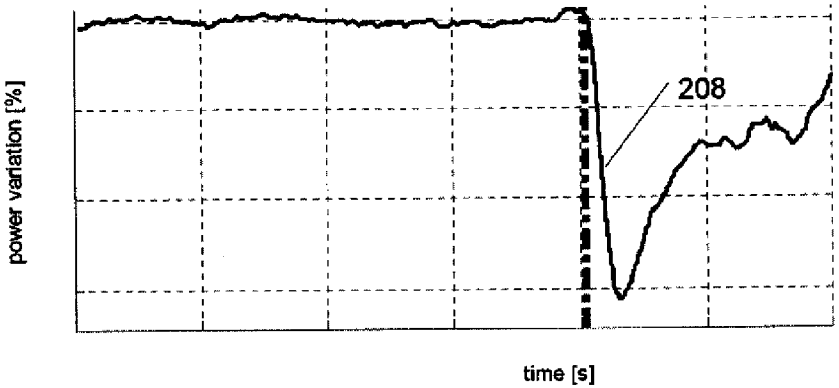
FIG. 5B is a graph of a relative power variation of the pool pump when a clogged suction pipe or water outlet occurs at a certain time.
Figure 5C:
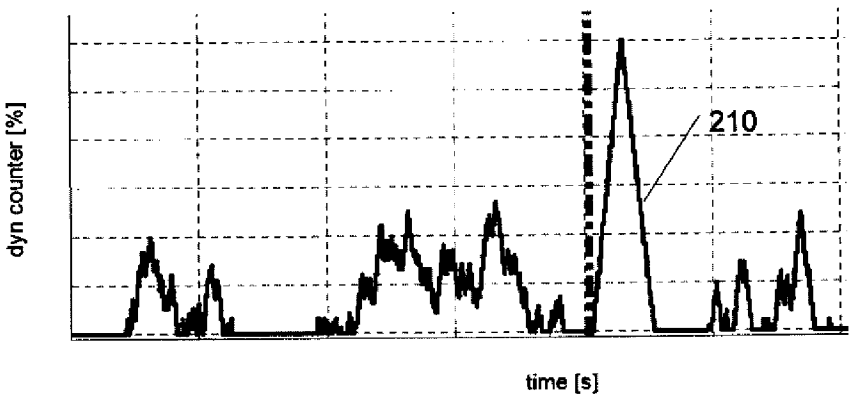
FIG. 5C is a graph of a relative counter for the relative power variation of FIG. 5B.

FIGS. 5A-5C illustrate power consumption curves associated with the motor shaft 56 of the pool pump 10. The power consumption of the motor that is necessary to pump water and overcome losses will be referred to herein and in the appended claims as any one of "power consumption curves," "power consumption values," or simply "power consumption." FIG. 5A illustrates power consumption curves for the motor shaft 56 when the inlet 18 is obstructed at a particular time 200. FIG. 5A illustrates an actual power consumption curve 202, a current power consumption curve 204, and a lagged power consumption curve 206. The actual power consumption 202 (measured at step 218 of the flow chart illustrated in FIG. 8) can be evaluated by the on-board controller 16 during a certain time interval (e.g., about 20 milliseconds).

Figure 8:
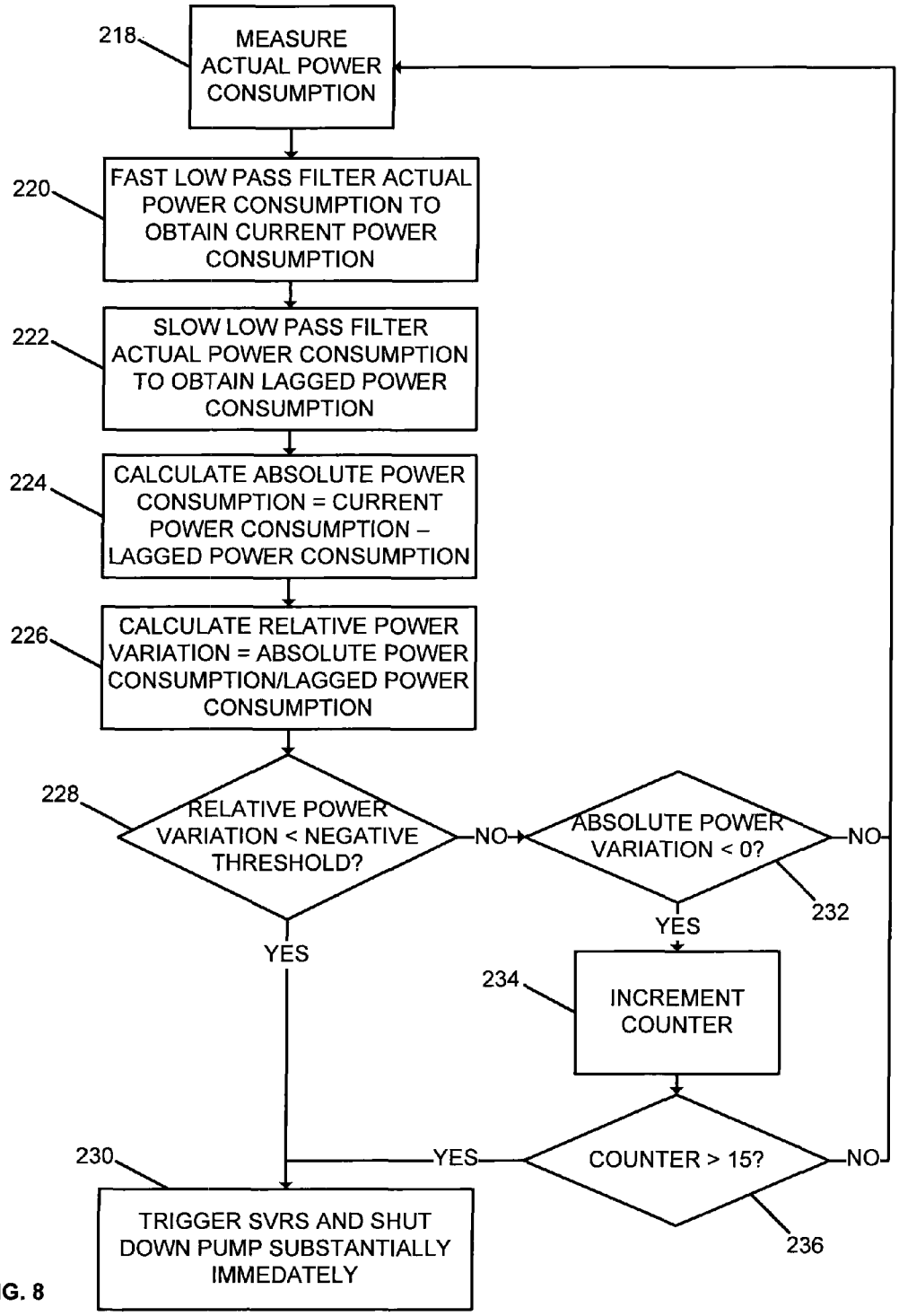
FIG. 8 is a flow chart illustrating a method of operating a safety vacuum release system with a controller for a pump.

In some embodiments, the on-board controller 16 can filter the actual power consumption 202 using a fast low-pass filter to obtain the current power consumption 204 (at step 220 of FIG. 8). The current power consumption 204 can represent the actual power consumption 202; however, the current power consumption 204 can be substantially smoother than the actual power consumption 202. This type of signal filtering can result in "fast detection" (also referred to as "dynamic detection") of any obstructions in the pumping system (e.g., based on dynamic behavior of the shaft power when the inlet 18 is blocked suddenly). In some embodiments, the fast low-pass filter can have a time constant of about 200 milliseconds.

In some embodiments, the on-board controller 16 can filter the signal for the actual power consumption 202 using a slow low-pass filter to obtain the lagged power consumption 206 (at step 222 of FIG. 8). The lagged power consumption 206 can represent the actual power consumption from an earlier time period. If the inlet 18 is obstructed at the time instance 200, the actual power consumption 202 will rapidly drop. The current power consumption 204 can substantially follow the drop of the actual power consumption 202. However, the lagged power consumption 206 will drop substantially slower than the actual power consumption 202. As a result, the lagged power consumption 206 will generally be higher than the actual power consumption 202. This type of signal filtering can result in "slow detection" (also referred to as "dead head detection" or "static detection") of any obstructions in the pumping system (e.g., when there is an obstruction in the pumping system and the pool pump 10 runs dry for a few seconds). In some embodiments, the slow low-pass filter can have a time constant of about 1400 milliseconds.

The signal filtering of the actual power consumption 202 can be performed over a time interval of about 2.5 seconds, resulting in a reaction time between about 2.5 seconds and about 5 seconds, depending on when the dead head condition occurs during the signal filtering cycle. In some embodiments, the static detection can have a 50% sensitivity which can be defined as the power consumption curve calculated from a minimum measured power plus a 5% power offset at all speeds from about 1500 RPM to about 3450 RPM. When the sensitivity is set to 0%, the static detection can be disabled.

FIG. 5B illustrates a relative power consumption curve 208 of the pool pump 10 for the same scenario of FIG. 5A. In some embodiments, the relative power consumption 208 can be computed by calculating the difference between the current power consumption 204 and the lagged power consumption 206 (i.e., the "absolute power variation", calculated at step 224 of FIG. 8) divided by the current power consumption 204. The greater the difference between the time constants of the fast and slow filters, the higher the time frame for which absolute power variation can be calculated. In some embodiments, the absolute power variation can be updated about every 20 milliseconds for dynamic detection of obstructions in the pumping system. Due to the lagged power consumption 206 being higher than the current power consumption 204, a negative relative power consumption 208 can be used by the SVRS of the on-board controller 16 to identify an obstructed inlet 18.

The relative power consumption 208 can also be used to determine a "relative power variation" (also referred to as a "power variation percentage"). The relative power variation can be calculated, at step 226 of FIG. 8, by subtracting the lagged power consumption 206 from the current power consumption 204 and dividing by the lagged power consumption 206. When the inlet 18 is blocked, the relative power variation will be negative as shaft power decreases rapidly in time. A negative threshold can be set for the relative power variation. If the relative power variation exceeds the negative threshold, as determined at step 228 of FIG. 8, the SVRS can identify an obstructed inlet 18 and shut down the pool pump 10 substantially immediately (at step 230 of FIG. 8). In one embodiment, the negative threshold for the relative power variation can be provided for a speed of about 2200 RPM and can be provided as a percentage multiplied by ten for increased resolution. The negative threshold for other speeds can be calculated by assuming a second order curve variation and by multiplying the percentage at 800 RPM by six and by multiplying the percentage at 3450 RPM by two. In some embodiments, the sensitivity of the SVRS can be altered by changing the percentages or the multiplication factors.

In some embodiments, the on-board controller 16 can include a dynamic counter. In one embodiment, a dynamic counter value 210 can be increased by one value if the absolute power variation is negative (as shown at steps 232 and 234 of FIG. 8). The dynamic counter value 210 can be decreased by one value if the absolute power variation is positive. In some embodiments, if the dynamic counter value 210 is higher than a threshold (e.g., a value of about 15 so that the counter needs to exceed 15 to trigger an obstructed inlet alarm), as determined at step 236 of FIG. 8, a dynamic suction blockage is detected and the pool pump 10 is shut down substantially immediately (at step 230 of FIG. 8). The dynamic counter value 210 can be any number equal to or greater than zero. For example, the dynamic counter value 210 may remain at zero indefinitely if the shaft power continues to increase for an extended time period. However, in the case of a sudden inlet blockage, the dynamic counter value 210 will rapidly increase, and once it increases beyond the threshold value of 15, the pool pump 10 will be shut down substantially immediately. In some embodiments, the threshold for the dynamic counter value 210 can depend on the speed of the motor 14 (i.e., the thresholds will follow a curve of threshold versus motor speed). In one embodiment, the dynamic detection can monitor shaft power variation over about one second at a 20 millisecond sampling time to provide fast control and monitoring. FIG. 5C illustrates the dynamic counter value 210 of the dynamic counter for the relative power consumption 208 of FIG. 5B.

In one embodiment, the SVRS can determine that there is an obstructed inlet 18 when both of the following events occur: (1) the relative power variation exceeds a negative threshold; and (2) the dynamic counter value 210 exceeds a positive threshold (e.g., a value of 15). When both of these events occur, the on-board controller 16 can shut down the pool pump 10 substantially immediately. However, in some embodiments, one of these thresholds can be disabled. The relative power variation threshold can be disabled if the relative power variation threshold needs only to be negative to trigger the obstructed inlet alarm. Conversely, the dynamic counter can be disabled if the dynamic counter value needs only to be positive to trigger the obstructed inlet alarm.

The on-board controller 16 can evaluate the relative power consumption 208 in a certain time interval. The on-board controller 16 can adjust the dynamic counter value 210 of the dynamic counter for each time interval. In some embodiments, the time interval can be about 20 milliseconds. In some embodiments, the on-board controller 16 can trigger the SVRS based on one or both of the relative power consumption 208 and the dynamic counter value 210 of the relative counter. The values for the relative power consumption 208 and the dynamic counter value 210 when the on-board controller 16 triggers the SVRS can be programmed into the on-board controller 16.

Figure 6:
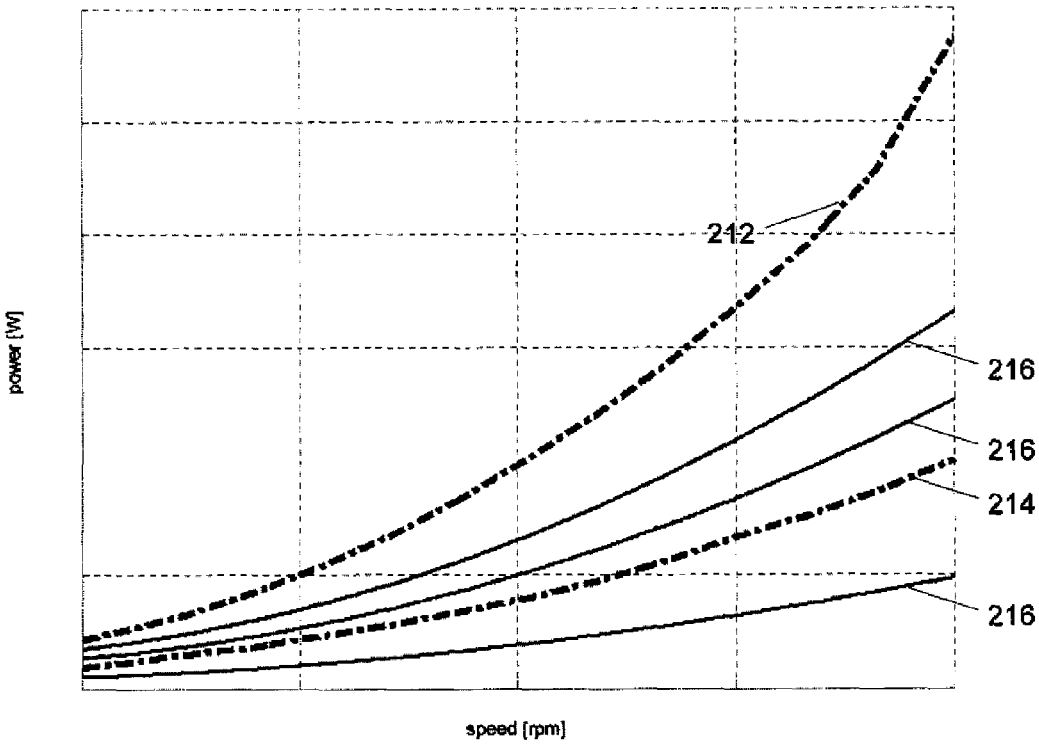
FIG. 6 is a graph of a power consumption versus the speed of the pool pump according to one embodiment of the invention.

FIG. 6 illustrates a maximum power consumption curve 212 and a minimum power consumption curve 214 versus the speed of the pool pump 10 according to one embodiment of the invention. In some embodiments, the maximum power consumption curve 212 and/or the minimum power consumption curve 214 can be empirically determined and programmed into the on-board controller 16. The maximum power consumption curve 212 and the minimum power consumption curve 214 can vary depending on the size of the piping system coupled to the pool pump 10 and/or the size of the aquatic applications. In some embodiments, the minimum power consumption curve 214 can be defined as about half the maximum power consumption curve 212.

FIG. 6 also illustrates several intermediate power curves 216. The maximum power consumption curve 212 can be scaled with different factors to generate the intermediate power curves 216. The intermediate power curve 216 resulting from dividing the maximum power consumption curve 212 in half can be substantially the same as the minimum power consumption curve 214. The scaling factor for the maximum power consumption 212 can be programmed into the on-board controller 16. One or more of the maximum power consumption 212 and the intermediate power curves 216 can be used as a threshold value to detect an obstructed inlet 18. In some embodiments, the on-board controller 16 can trigger the SVRS if one or both of the actual power consumption 202 and the current power consumption 204 are below the threshold value.

In some embodiments, the on-board controller 16 can include an absolute counter. If the actual power consumption 202 and/or the current power consumption 204 is below the threshold value, a value of the absolute counter can be increased. A lower limit for the absolute counter can be set to zero. In some embodiments, the absolute counter can be used to trigger the SVRS. The threshold value for the absolute counter before the SVRS is activated can be programmed into the on-board controller 16. In some embodiments, if the absolute counter value is higher than a threshold (e.g., a value of about 10 so that the counter needs to exceed 10 to trigger an obstructed inlet alarm), a dead head obstruction is detected and the pool pump 10 is shut down substantially immediately. In other words, if the actual power consumption 202 stays below a threshold power curve (as described below) for 10 times in a row, the absolute counter will reach the threshold value of 10 and the obstructed inlet alarm can be triggered for a dead head condition.

For use with the absolute counter, the threshold value for the actual power consumption 202 can be a threshold power curve with a sensitivity having a percentage multiplied by ten. For example, a value of 500 can mean 50% sensitivity and can correspond to the measured minimum power curve calculated using second order approximation. A value of 1000 can mean 100% sensitivity and can correspond to doubling the minimum power curve. In some embodiments, the absolute counter can be disabled by setting the threshold value for the actual power consumption 202 to zero. The sensitivity in most applications can be above 50% in order to detect a dead head obstruction within an acceptable time period. The sensitivity in typical pool and spa applications can be about 65%.

In some embodiments, the SVRS based on the absolute counter can detect an obstructed inlet 18 when the pool pump 10 is being started against an already blocked inlet 18 or in the event of a slow clogging of the inlet 18. The sensitivity of the SVRS can be adjusted by the scaling factor for the maximum power consumption 212 and/or the value of the absolute counter. In some embodiments, the absolute counter can be used as an indicator for replacing and/or cleaning the strainer 42 and/or other filters installed in the piping system of the aquatic applications.

In some embodiments, the dynamic counter and/or the absolute counter can reduce the number of nuisance trips of the SVRS. The dynamic counter and/or the absolute counter can reduce the number of times the SVRS accidently shuts down the pool pump 10 without the inlet 18 actually being obstructed. A change in flow rate through the pool pump 10 can result in variations in the absolute power consumption 202 and/or the relative power consumption 208 that can be high enough to trigger the SVRS. For example, if a swimmer jumps into the pool, waves can change the flow rate through the pool pump 10 which can trigger the SVRS, although no blockage actually occurs. In some embodiments, the relative counter and/or the absolute counter can prevent the on-board controller 16 from triggering the SVRS if the on-board controller 16 changes the speed of the motor 14. In some embodiments, the controller 16 can store whether the type of obstructed inlet was a dynamic blocked inlet or a dead head obstructed inlet.

The actual power consumption 202 varies with the speed of the motor 14. However, the relative power consumption 208 can be substantially independent of the actual power consumption 202. As a result, the power consumption parameter of the motor shaft 56 by itself can be sufficient for the SVRS to detect an obstructed inlet 18 over a wide range of speeds of the motor 14. In some embodiments, the power consumption parameter can be used for all speeds of the motor 14 between the minimum speed setting 124 and the maximum speed setting 126. In some embodiments, the power consumption values can be scaled by a factor to adjust a sensitivity of the SVRS. A technician can program the power consumption parameter and the scaling factor into the on-board controller 16.

Figure 7:
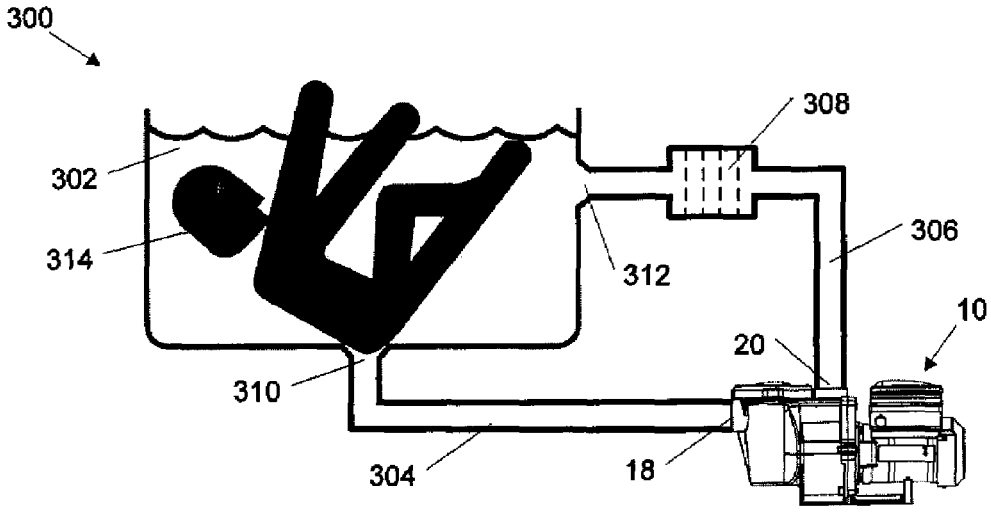
FIG. 7 is a schematic illustration of a pool system with a person blocking a water outlet of the pool.

FIG. 7 illustrates a pool or spa 300 with a vessel 302, an outlet pipe 304, an inlet pipe 306, and a filter system 308 coupled to the pool pump 10. The vessel 302 can include an outlet 310 and an inlet 312. The outlet pipe 304 can couple the outlet 310 with the inlet 18 of the pool pump 10. The inlet pipe 306 can couple the outlet 20 of the pool pump 10 with the inlet 312 of the vessel 302. The inlet pipe 306 can be coupled to the filter system 308.

An object in the vessel 302, for example a person 314 or a foreign object, may accidently obstruct the outlet 310 or the inlet 18 may become obstructed over time. The on-board controller 16 can detect the blocked inlet 18 of the pool pump 10 based on one or more of the actual power consumption 202, the current power consumption 204, the relative power consumption 208, the dynamic counter, and the absolute counter. In some embodiments, the on-board controller 16 can trigger the SVRS based on the most sensitive (e.g., the earliest detected) parameter. Once an obstructed inlet 18 has been detected, the SVRS can shut down the pool pump 10 substantially immediately. The on-board controller 16 can illuminate an LED 96 on the user interface 60 and/or can activate an audible alarm. In some embodiments, the on-board controller 16 can restart the pool pump 10 automatically after the time period for the SVRS automatic restart 128 has elapsed. In some embodiments, the on-board controller 16 can delay the activation of the SVRS during start up of the pool pump 10. In some embodiments, the delay can be about two seconds.

If the inlet 18 is still obstructed when the pool pump 10 is restarted, the SVRS will be triggered again. Due to the pool pump 10 being started against an obstructed inlet 18, the relative power consumption 208 may be inconclusive to trigger the SVRS. However, the on-board controller 16 can use the actual power consumption 202 and/or the current power consumption 204 to trigger the SVRS. In some embodiments, the SVRS can be triggered based on both the relative power consumption 208 and the actual power consumption 202.

In some embodiments, the SVRS can be triggered for reasons other than the inlet 18 of the pool pump 10 being obstructed. For example, the on-board controller 16 can activate the SVRS if one or more of the actual power consumption 202, the current power consumption 204, and the relative power consumption 208 of the pool pump 10 varies beyond an acceptable range for any reason. In some embodiments, an obstructed outlet 20 of the pool pump 10 can trigger the SVRS. In some embodiments, the outlet 20 may be obstructed anywhere along the inlet pipe 306 and/or in the inlet 312 of the pool or spa 300. For example, the outlet 20 could be obstructed by an increasingly-clogged strainer 42 and/or filter system 308.

In some embodiments, the number of restarts of the pool pump 10 after time period for the SVRS automatic restart 128 has been elapsed can be limited in order to prevent excessive cycling of the pool pump 10. For example, if the filter system 308 is clogged, the clogged filter system 308 may trigger the SVRS every time the pool pump 10 is restarted by the on-board controller 16. After a certain amount of failed restarts, the on-board controller 16 can be programmed to stop restarting the pool pump 10. The user interface 60 can also indicate the error on the display 62. In some embodiments, the user interface 60 can display a suggestion to replace and/or check the strainer 42 and/or the filter system 308 on the display 62.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A method of operating a safety vacuum release system with a controller for a pump including a motor, the method comprising:

measuring an actual power consumption of the motor necessary to pump water and overcome losses;

calculating an absolute power variation based on the actual power consumption;

incrementing a dynamic counter value if the absolute power variation is negative;

calculating a relative power variation based on the actual power consumption;

identifying a dynamic suction blockage if at least one of the dynamic counter exceeds a dynamic counter threshold value and the relative power variation is below a negative threshold; and triggering the safety vacuum release system when the dynamic suction blockage is identified in order to shut down the pump substantially immediately.

2. The method of claim 1 and further comprising:

filtering the actual power consumption with a fast low-pass filter to obtain a current power consumption;

filtering the actual power consumption with a slow low-pass filter to obtain a lagged power consumption; and calculating the absolute power variation by subtracting the lagged power consumption from the current power consumption.

3. The method of claim 2 wherein the fast low-pass filter has a time constant of about 200 milliseconds and the slow low-pass filter has a time constant of about 1400 milliseconds.

4. The method of claim 2 wherein the actual power consumption is filtered for about 2.5 seconds.

5. The method of claim 2 wherein the absolute power variation is updated about every 20 milliseconds to provide dynamic suction blockage detection.

6. The method of claim 2 and further comprising calculating a relative power consumption by dividing the absolute power variation by the current power consumption.

7. The method of claim 2 and further comprising incrementing an absolute counter value if at least one of the actual power consumption and the current power consumption is greater than a threshold power curve.

8. The method of claim 7 and further comprising identifying a dead head condition if the absolute counter value exceeds an absolute counter threshold value.

9. The method of claim 8 wherein the absolute counter threshold value is 10.

10. The method of claim 8 and further comprising restarting the pump after a time period has elapsed.

11. The method of claim 10 and further comprising preventing the pump from being restarted if the dead head condition is identified again.

12. The method of claim 1 wherein the dynamic counter threshold value is 15.

* * * * *